US010393465B2

(12) United States Patent
Cheng et al.

(10) Patent No.: US 10,393,465 B2
(45) Date of Patent: Aug. 27, 2019

(54) 3-IN-1 MOUNT ADAPTER

(71) Applicants: Carson Cheng, City of Industry, CA (US); Changan Tian, City of Industry, CA (US); Richard Thomas, City of Industry, CA (US)

(72) Inventors: Carson Cheng, City of Industry, CA (US); Changan Tian, City of Industry, CA (US); Richard Thomas, City of Industry, CA (US)

(73) Assignee: NcSTAR Inc., City of Industry, CA (US)

( * ) Notice: Subject to any disclaimer, the term of this patent is extended or adjusted under 35 U.S.C. 154(b) by 0 days.

(21) Appl. No.: 15/708,105

(22) Filed: Sep. 18, 2017

(65) Prior Publication Data

US 2019/0086176 A1 Mar. 21, 2019

(51) Int. Cl.
*F41A 23/10* (2006.01)
*F41G 11/00* (2006.01)

(52) U.S. Cl.
CPC ..... *F41A 23/10* (2013.01); *F41G 11/003* (2013.01)

(58) Field of Classification Search
CPC ..... F41A 23/10
USPC ..... 42/94, 90
See application file for complete search history.

(56) References Cited

U.S. PATENT DOCUMENTS 5,074,188 A * 12/1991 Harris ..... F41A 23/08 42/94
5,711,103 A * 1/1998 Keng ..... F41A 23/08 42/94
7,631,455 B2 * 12/2009 Keng ..... F16M 11/10 248/163.1
7,861,451 B1 * 1/2011 Moody ..... F41A 23/08 42/71.01
2008/0295379 A1 * 12/2008 Potterfield ..... F41A 23/10 42/94
2009/0038200 A1 * 2/2009 Keng ..... F41A 23/10 42/94
2015/0267993 A1 * 9/2015 Cheng ..... F41C 27/00 42/90
2015/0285583 A1 * 10/2015 Mayberry ..... F41G 11/005 42/71.01
2015/0285584 A1 * 10/2015 Mayberry ..... F41C 23/16 42/71.01

* cited by examiner

*Primary Examiner* — Samir Abdosh
(74) *Attorney, Agent, or Firm* — Raymond Y. Chan; David and Raymond Patent Firm

(57) ABSTRACT

A 3-in-1 mount adapter for a firearm having an engagement interface with a plurality of openings includes an attachment base having at least one mounting hole; a mounting plate including at least one ridge receiving through hole aligned with the mounting hole; and at least one fastener assembly including a nut having a ridge passed through the ridge receiving through hole and the openings of said firearm, and a bolt having a threaded portion engaged with the nut and screwed in the mounting hole for affixing the attachment base with the mounting plate; wherein the nut includes a nut head radially extended from the ridge and having an cross sectional area larger than an area of the mounting hole to block the nut head on the mounting plate.

16 Claims, 10 Drawing Sheets

3-IN-1 MOUNT ADAPTER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a mount adapter, and more particularly to a 3-in-1 mount adapter incorporated with a bipod for mounting the bipod on three main kinds of firearm attachment system, and adapted to incorporate with a variety wide range of quick-releasing mounts.

Description Of Related Arts

When operating a firearm, it is commonly for the operator to mount a firearm on a bipod. Most commercially-available firearms are provided with rails where the accessories can be mounted, wherein there are three popular types of rails, which are "Picatinny" rail, "Keymod" rail, "Weaver" rail, and "M-lok" rail, and different kinds of rails are applied on different types of firearms manufactured from different companies. Therefore, in order to achieve the secure attachment for the bipod, individual mounts have been required for various manufacturers of firearms on the market.

Accordingly, it is very inconvenience for the operators to use a single bipod to several different firearms. In order for them to mount the single bipod on a variety of firearms, adaptors compatible for various types of rail system on the firearms are required to prepare. However, each adaptor is commonly adapted to only one or two kinds of rail system based on different mounting interfaces of the rail system. In other words, each individual rail system is designed to compatible with each individual adaptor. For example, the Keymod adaptor is only can be used on "Keymod" rail system, which cannot be used on "M-lok" rail system. However, an improved adaptor is provided to compatible for both "Picatinny" and "Keymod" rail systems, and the configuration of the adaptor is only connected the "Picatinny" and "Keymod" adaptor together, so the volume of the adaptor is naturally increased. In addition, the improved adaptor is still not a universal adaptor for compatible to various rail systems commonly provided on the current market.

In the process to mount the bipod on the firearm, an individual adaptor is required to be mounted on the bipod first, and then the bipod with the adaptor can be mounted on the rail system of the firearm. This process is cumbersome and time-consuming to detach and attach the adaptor on the bipod every time when the operators want to use the bipod. Therefore, the operators are not only to prepare various types of adaptors compatible with different rail systems, but also to install the adaptor on the bipod first in order to successfully mount the bipod on the firearm.

SUMMARY OF THE PRESENT INVENTION

The invention is advantageous in that it provides a 3-in-1 adapter incorporated with a bipod to not only support the bipod being directly mounted on an object without an individual mount, but also able to be incorporated with a quick-releasing mount if needed.

Another advantage of the invention is to provide a 3-in-1 adapter, wherein a pair of leg frame is pivotally connected with an attachment base of the 3-in-1 mount adapter, and at the same time, the 3-in-1 mount adapter is associated with the firearm attachment system to support the firearm on a surface through the leg frame.

Another advantage of the invention is to provide a 3-in-1 mount adapter, wherein the 3-in-1 mount adaptor comprises an attachment base, a mounting plate which is affixed with the attachment base by at least one screw, and at least one fastener assembly to affix the mounting plate on the object, so as to directly affix the 3-in-1 mount adaptor on the object.

Another advantage of the invention is to provide a 3-in-1 mount adaptor, wherein the mounting plate is adapted to directly arrange and affix between a quick-releasing mount and the attachment base by at least one bolt of the fastener assembly. Therefore, the 3-in-1 adaptor also can be incorporated with a well know quick-releasing mount, so as to enhance a practice use of the mount adapter.

Another advantage of the invention is to provide a 3-in-1 mount adapter, wherein the fastener assembly comprises at least one nut associated with an engagement interface of the object, wherein the nut can be designed as an elongated nut or a circular nut adapted to incorporate with the "Key-mod" or "M-lok" rail engagement interface section, which does not require altering the original structural design of the mount adapter to mount on the different surface of object, so as to minimize the unnecessary component of the 3-in-1 mount adapter and to reduce the overall weight of the 3-in-1 mount adapter.

Another advantage of the invention is to provide a 3-in-1 mount adapter, which can be incorporated with more than one existing firearm attachment system.

Another advantage of the invention is to provide a 3-in-1 mount adapter, wherein no expensive or complicated structure is required to employ in the present invention in order to achieve the above mentioned objects. Therefore, the present invention successfully provides an economic and efficient solution for providing a 3-in-1 adapter to minimize additional mount adapter adapted to different kinds of firearm attachment system.

Additional advantages and features of the invention will become apparent from the description which follows, and may be realized by means of the instrumentalities and combinations particular point out in the appended claims.

According to the present invention, the foregoing and other objects and advantages are attained by a 3-in-1 mount adapter for a firearm having an engagement interface with a plurality of openings, comprising:

an attachment base having at least one mounting hole;

a mounting plate comprising at least one ridge receiving through hole aligned with the mounting hole; and at least one fastener assembly comprising a nut having a ridge passed through the ridge receiving through hole and the openings of the firearm, and a bolt comprising a threaded portion engaged with the nut and screwed in the mounting hole for affixing the attachment base with the mounting plate; wherein the nut comprises a nut head radially extended from said ridge and having a cross sectional area larger than an area of the mounting hole to block the nut head on the mounting plate.

In accordance with another aspect of the invention, the present invention comprises a method for affixing a 3-in-1 mount adapter on a firearm having an engagement interface with a plurality of openings comprising the steps of:

(1) screwing at least one screw in a affixing hole of a attachment base and into a screw of a mounting plate respectively;

(2) screwing a threaded portion of a bolt in a mounting hole of the mounting plate, and the threaded portion of said bolt is passed through a ridge receiving through hole of the attachment hole; and (3) screwing a nut with the threaded portion of the bolt to affix said engagement interface between a nut head of the nut and the mounting plate.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
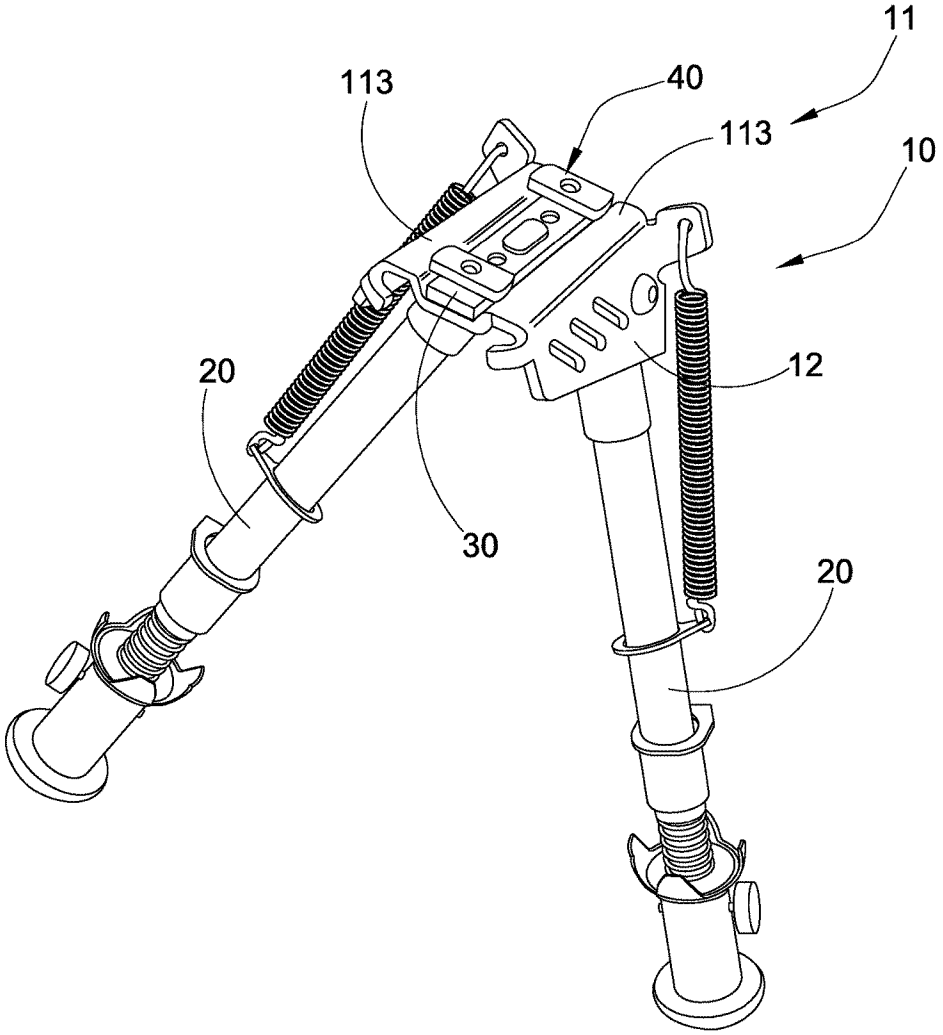
FIG. 1 is a perspective view of a 3-in-1 adapter engaged with a leg frame according to a preferred embodiment of the present invention.
Figure 2:
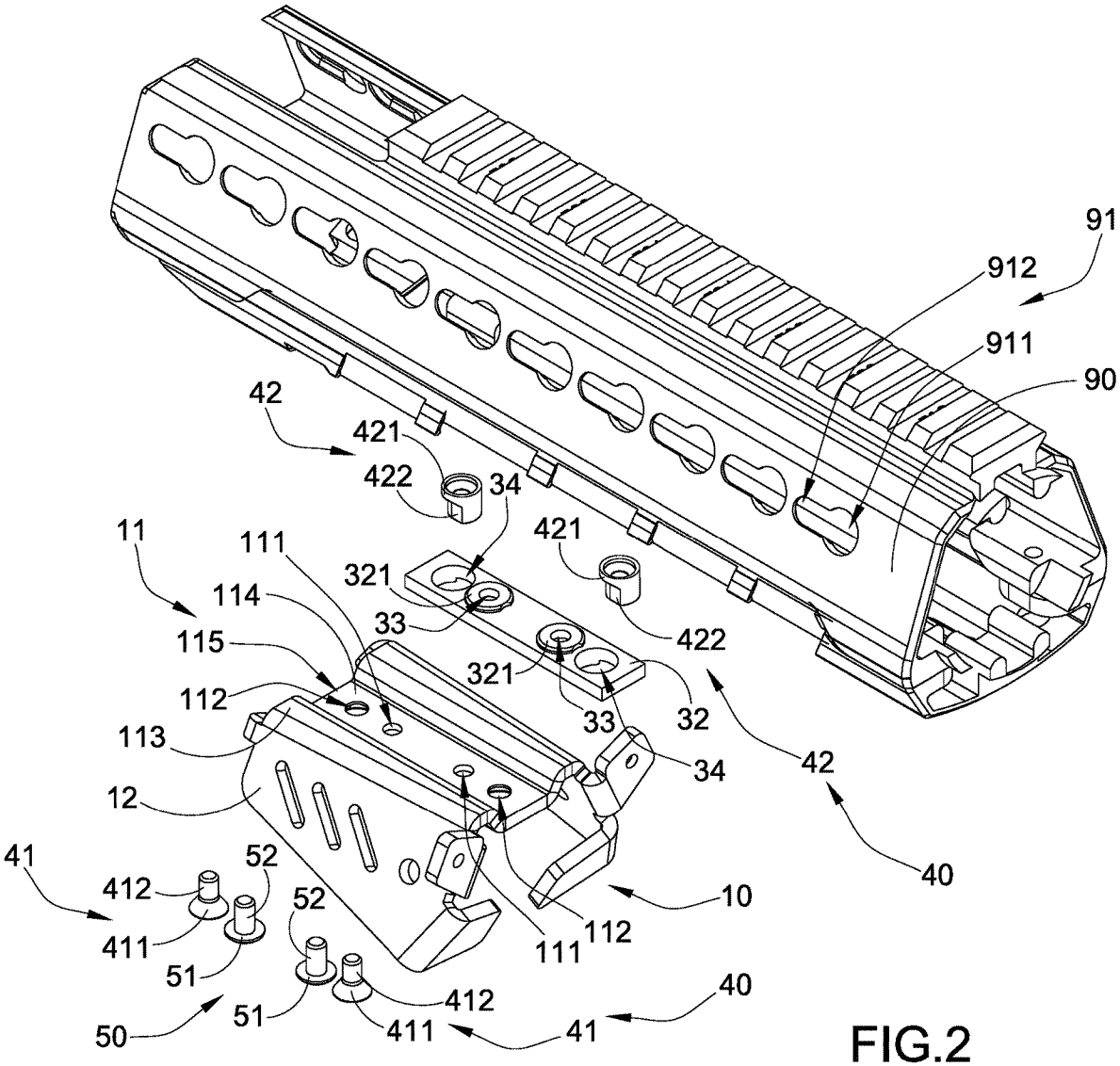
FIG. 2 is an exploded view of a 3-in-1 adapter while the 3-in-1 adapter is applied to a Key-mod rail engagement interface according to the above mentioned preferred embodiment of the present invention.
Figure 3:
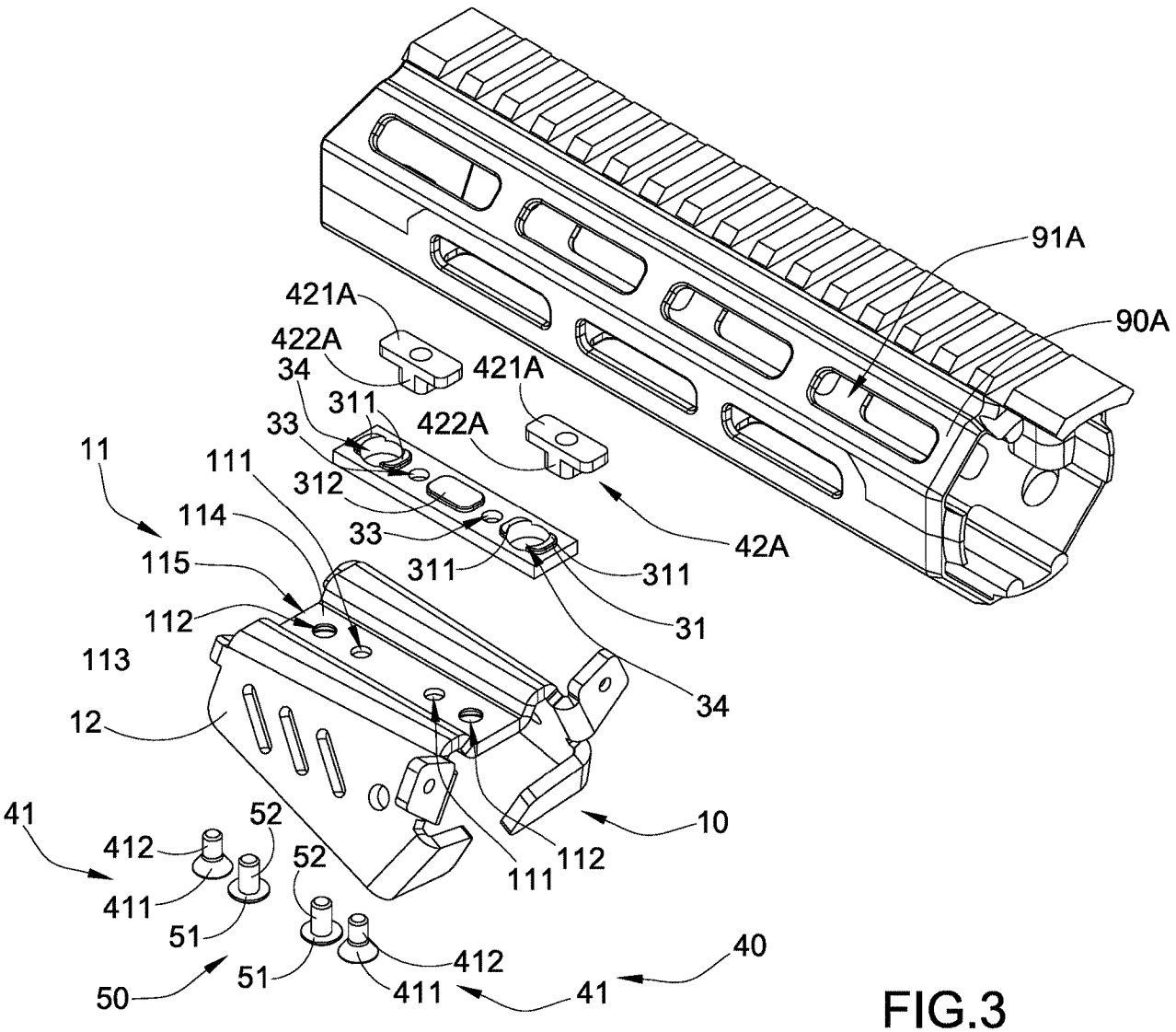
FIG. 3 is an exploded view of a 3-in-1 adapter while the 3-in-1 adapter is applied to a M-lok rail engagement interface according to the above mentioned preferred embodiment of the present invention.

Referring to FIG. 1 to FIG. 3 of the drawings, a 3-in-1 adapter according to a preferred embodiment of the present invention is illustrated, wherein the 3-in-1 adapter is used to securely mount on an engagement interface 90 of an object, which is shown as a handguard of a firearm according to the preferred embodiment of the present invention. The engagement interface 90 comprises a plurality of openings 91 that oriented in a row, wherein the engagement interface 90 is selectively defined as a "Key-mod", "M-lok", "Picatinny" rail engagement interface, 90, 90A, and 90B. Therefore, shapes and configurations of openings 91 on engagement interface 90 are defined based on the types of the rail engagement interface 90, wherein the openings 91 are defined as Key-mod openings 91, M-lok openings 91A, and Picatinny openings 91B.

Accordingly, the 3-in-1 adapter comprises an attachment base 10 for detachably coupling with the engagement interface 90 of the firearm, a pair of hollow and retractable leg frames 20 pivotally engaged with the attachment base 10 to stably hold and support the firearm in a position, and a mounting plate 30 for detachably engaging with the attachment base 10 with the hollow leg frames 20 for support the attachment base 10 being coupled with the firearm, so that the operator of the firearm, such as rifle or machine which need to be stably support thereon, is able to easily detach the firearm from the leg frames 20 via the 3-in-1 adapter.

As shown in FIG. 2, the attachment base 10 comprises a top wall 11, two inclined side walls 12 integrally and downwardly extended from the top wall 11, at least one affixing hole 111 located on the top wall 11, and at least one mounting hole 112 located on the top wall 11, wherein the leg frames 20 are pivotally connected on the two inclined side walls 12 for pivotally folding the leg frames 20 between an unfolded position and a folded position. The top wall 11 comprises two top side walls 113, and a concave wall 114 downwardly extended from two top side walls 113 to form a receiving cavity 115 for receiving the mounting plate 30, wherein the affixing hole 111 and the mounting hole 112 are located on the concave wall 114 in a line as well as a longitudinal central line of the concave wall 114.

According to the preferred embodiment, the 3-in-1 mount adapter further comprises at least one fastener assembly 40 associated with the mounting plate 30 and the attachment base 10 to secure the 3-in-1 mount adapter with the engagement interface 90, and at least one screw 50 having a screw head 51 and a screw tail 52 for mounting the mounting plate 30 on the top wall 11 of the attachment base 10, wherein the mounting plate 30 is received into the receiving cavity 115 to form a flat connection surface, so the engagement interface 90 of the firearm can be securely supported on the flat connection surface. In other words, the mounting plate 30 is not protruded from the attachment base 10. Each of the fastener assemblies 40 comprises a bolt 41 that is defined by a head portion 411 and a threaded portion 412, and a nut 42 selectively designed as an elongated nut 42A or a circular nut 42 adapted to incorporate with the "Key-mod", "M-lok", "Picatinny" or "Weaver" rail engagement interface 90, 90A, and 90B. The elongated nut 42A comprises a first ridge 422A having a first threaded recess that is threadingly engaged with the threaded portion 412 of the bolt 41, and at least two ears 421A extended towards an outward radial direction from the first ridge 422A. In other words, the first ridge 422A extends in an axial direction and is associated with the threaded portion 412 of the bolt 41. Alternatively, the circular nut 42 comprises a second ridge 422 having a second threaded recess that is threadingly engaged with the threaded portion 412 of the bolt 41, and a circular nut head 421 extended towards the outward radial direction.

Accordingly, the mounting plate 30 comprises a top side 31, a bottom side 32, at least one screw hole 33 for associating with the screw tail 52 of the screw 50, and at least one ridge receiving through hole 34 for rotatably receiving the first and second ridge 422, 422A, wherein the top side 31 comprises at least one projection 311 positioned around an outer circumference of the ridge receiving through hole 34, and a second projection 312. Preferably, the screw hole 33, the ridge receiving through hole 24, the first projection 312, and the second projection 312 are located along a longitudinal and central line of the mounting plate 30. And, the bottom side 32 comprises at least one third projection 321 positioned around an outer circumference of the screw hole 33. It is worth mentioning that the first, second, and third projections 311, 312, 321 are shaped, positioned, and oriented to cooperate with the configuration of the engagement interface 90, 90A, 90B of the firearm. In other words, the first, second, and third projection 311, 312, 321 are shaped and positioned to match with the openings 91, 91A, 91B of the engagement interface 90, 90A, 90B.

Accordingly, a diameter of each of the affixing holes 111 is slightly smaller than a diameter of the screw head 51, and is slightly larger than a diameter of the screw tail 52, such that the screw tail 52 is screwed and passed through the affixing hole 111, and then the screw head 51 is blocked on the concave wall 114 of the attachment base 10. And, a diameter of the mounting hole 112 is slightly smaller than a diameter of the head portion 411 of the bolt 41, and slightly larger than a diameter of the threaded portion 412 of the bolt 41, so that the threaded portion 412 of the bolt 41 is passed through the mounting hole 112, and then the head potion 411 of the bolt 41 is blocked on the concave wall 114 of the attachment base 10.

Figure 4:
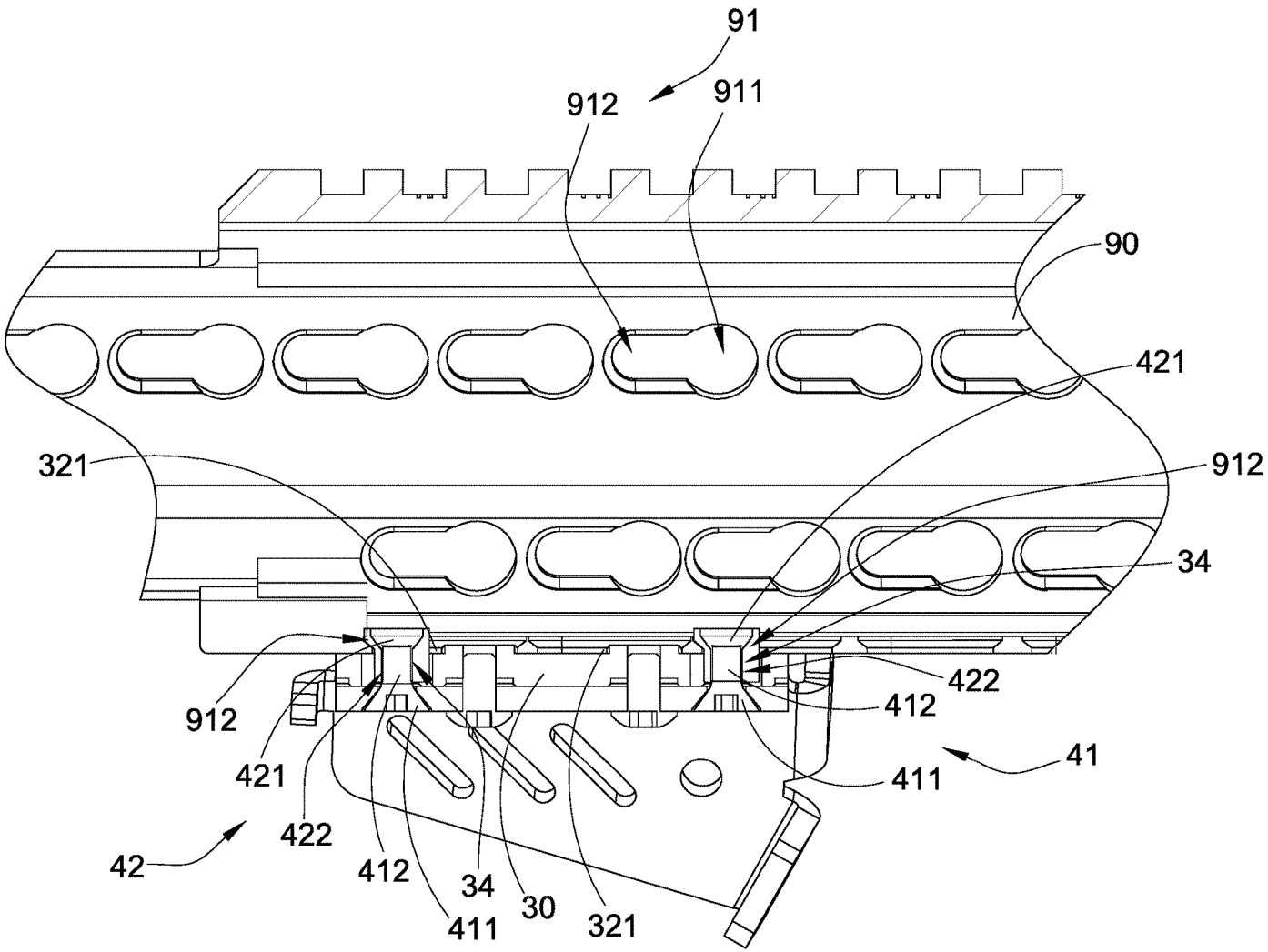
FIG. 4 is a sectional view of a 3-in-1 adapter engaged with a Key-mod rail engagement interface according to the above mentioned preferred embodiment of the present invention.

Referring to FIG. 4 of the drawings, the engagement interface 90 is defined as a "Key-mod" rail engagement interface 90, wherein the plurality of KeyMod openings 91 are oriented in rows and aligned with a longitudinal axis of a handguard of the firearm, wherein each of the Key-mod openings 91 has a Keyhole configuration to define an enlarged opening portion 911 and a narrower opening portion 912 extended from the enlarged opening portion 911.

In order to affix the 3-in-1 mount adapter on the engagement interface 90, the top side 31 of the mounting plate 30 is abutted with the concave wall 114 of the mounting plate 30, and the bottom side 32 is maintained in generally abutting cooperation with the engagement interface 90 of the firearm, wherein the engagement interface 90 of the firearm is sandwiched between the mounting plate 30 and the nut head 421. The screw tails 52 of the screws 50 are passed and screwed through the affixing hole 111 of the concave wall 114 and the screw hole 33 on the mounting plate 30, and at the same time the screw heads 51 of the screws 50 are blocked on the concave wall 114 of the attachment base 10 to affix the mounting plate 30 on the concave wall 114 of the attachment base 10.

It is worth mentioning that the circular nut 42 is adapted to apply to the "Key-mod" rail engagement interface 90. An area of a cross section of the second ridge 422 is slightly less than that of the enlarged opening portion 911 and the narrower opening portion 912 of the Key-mod opening 91. In addition, an area of a cross section of the circular nut head 421 is larger than that of the ridge receiving through hole 34, the narrower opening portion 912 of the Key-mod opening 91, and the enlarged opening portion 911 of the Key-mod opening 91.

Accordingly, the circular nut 42 of the fastener assembly 40 is able to move along the Key-mod openings 91 between a releasing position and a securing position. In the releasing position, each of the threaded portions 412 of the bolts 41 is passed through the mounting hole 112 of the concave wall 114 and the ridge receiving through hole 34 of the mounting plate 30, and then engaged with the second threaded recess of the second ridge 422 while the second ridge 422 is received into the ridge receiving hole 34, and at the same time, the circular nut head 421 is passed through the enlarged opening portion 911 of the Key-mod opening 91. And then, the second ridge 422 is slide along the enlarged opening portion 911 to the narrower opening portion 912, and the circular nut head 912 is synchronizedly slide from the enlarged opening portion 911 to the narrower opening portion 912. In the securing position, the circular nut head 422 is affixed on the narrower opening portion 912 of the Key-mod opening for affixing the 3-in-1 mount adapter with the engagement interface 90. In other words, in order to operate the 3-in-1 mount adapter from the releasing position to the securing position, the threaded portion 412 of the bolt 41 is rotated to affixedly engage with the second threaded recess of the second ridge 422.

At the same time, while the circular nut head 421 is slid from the enlarged opening portion 911 to the narrower opening portion 912, the third projection 321 is received into the one of the enlarged opening portions 911 of the Key-mod openings 91, wherein the thickness of the third projection 321 provide a clearance for a thickness of the engagement interface 90 of the firearm. In other words, the engagement interface 90 is sandwiched between the mounting plate 30 and the circular nut head 421. Therefore, the third projection 321 is adapted to increase friction forces generated between the mounting plate 30 and the engagement interface 90 to secure the engagement therebetween.

Figure 5:
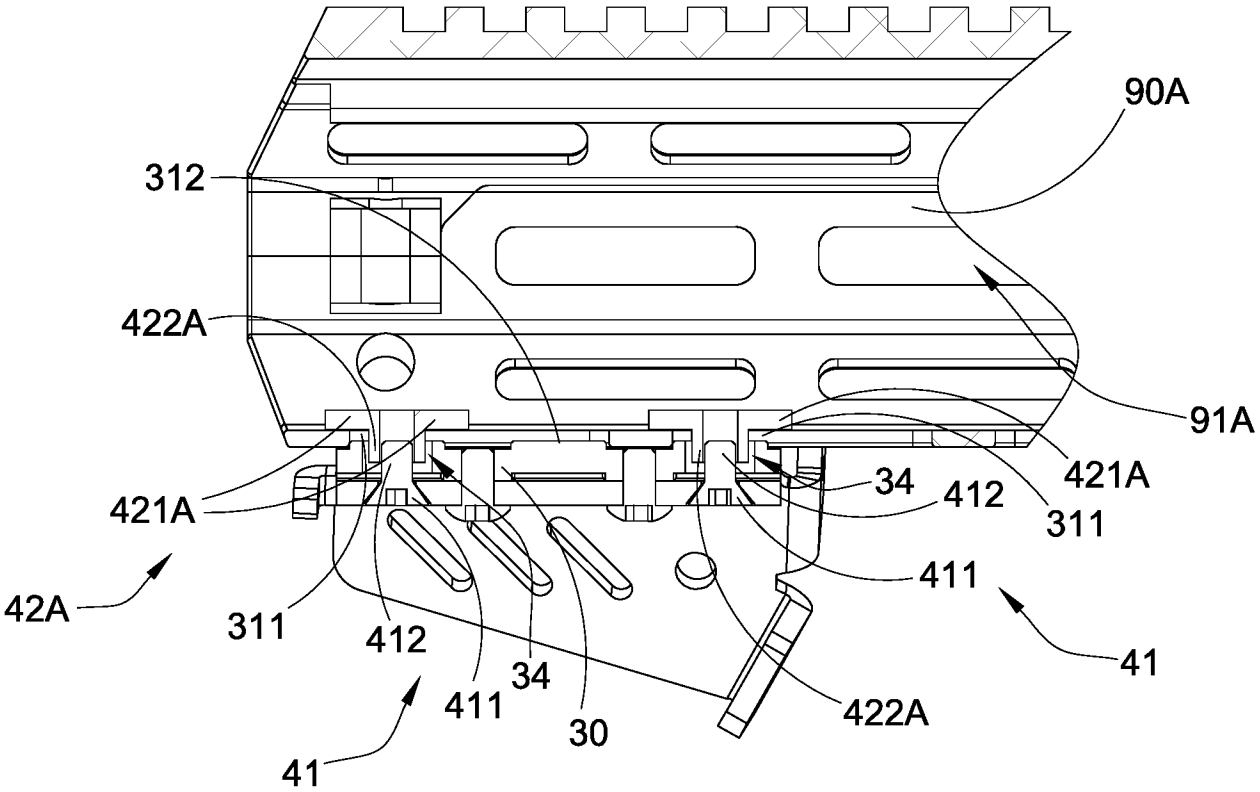
FIG. 5 is a sectional view of a 3-in-1 adapter engaged with a M-lok rail engagement interface according to the above mentioned preferred embodiment of the present invention.

Referring to FIG. 5 of the drawings, the engagement interface 90A is defined as a "M-lok" rail engagement interface 90A, wherein the plurality of M-lok openings 91A are oriented in rows and aligned with a longitudinal axis of a handguard of the firearm, wherein each of the M-mod openings 91A are elongated slots.

It is worth mentioning that the elongated nut 42A is adapted to apply to the "M-lok" rail engagement interface 90A. An area of a cross section of the first ridge 422A is slightly less than that of the ridge receiving through hole 34 and the Key-mod opening 91A. In addition, areas of two ears 421A of the elongated nut 42A are smaller than that of the M-lok openings 91A, so the two ears 421A are passed through the M-lok openings 91A.

In order to affix the 3-in-1 mount adapter on the engagement interface 90A, the bottom side 32 of the mounting plate 30 is abutted with the concave wall 114 of the mounting plate 30, and the top side 31 is maintained in generally abutting cooperation with the engagement interface 90A of the firearm, wherein the engagement interface 90A of the firearm is sandwiched between the mounting plate 30 and the two ears 421A of the elongated nut 42A. The screw tails 412 of the screws 41 are passed and screwed through the affixing hole 111 of the concave wall 114 and the screw hole 33 on the mounting plate 30, and at the same time the screw heads 411 of the screws 41 are blocked on the concave wall 114 of the attachment base 10 to affix the mounting plate 30 with the concave wall 114 of the attachment base 10.

Accordingly, the elongated nut 42A of the fastener assembly 40 is moved along M-lok openings 91A between a releasing position and a securing position. In the releasing position, the first and second projections 311, 312 are received in the M-lok openings 91A of the engagement interface 90A, and each of the threaded portions 412 of the bolts 41 is passed through the mounting hole 112 of the concave wall 114 and engaged with the first threaded recess of the first ridge 422A while the first ridge 422A is received into the ridge receiving through hole 34, and at the same time, the two ears 421A of the elongated nut 42A are arranged along a longitudinal direction with respect to the mounting plate 30. The two ears 421A are able to be passed through the M-lok openings 91A in the releasing position, and then two ears 421A are slid to an end of the M-lok openings 91A until one of the two ears 421A is overlapped with the engagement interface 91A of the firearm. And then, the threaded portion 412 of the bolt 41 is rotated to affixedly engage with the second recess of the first ridge 422A in the securing position for affixing the present invention on the engagement interface 90A. In other words, the bolt can be rotated to affix the two ears 421A for being blocked on the engagement interface 90A of the firearm.

Figure 6:
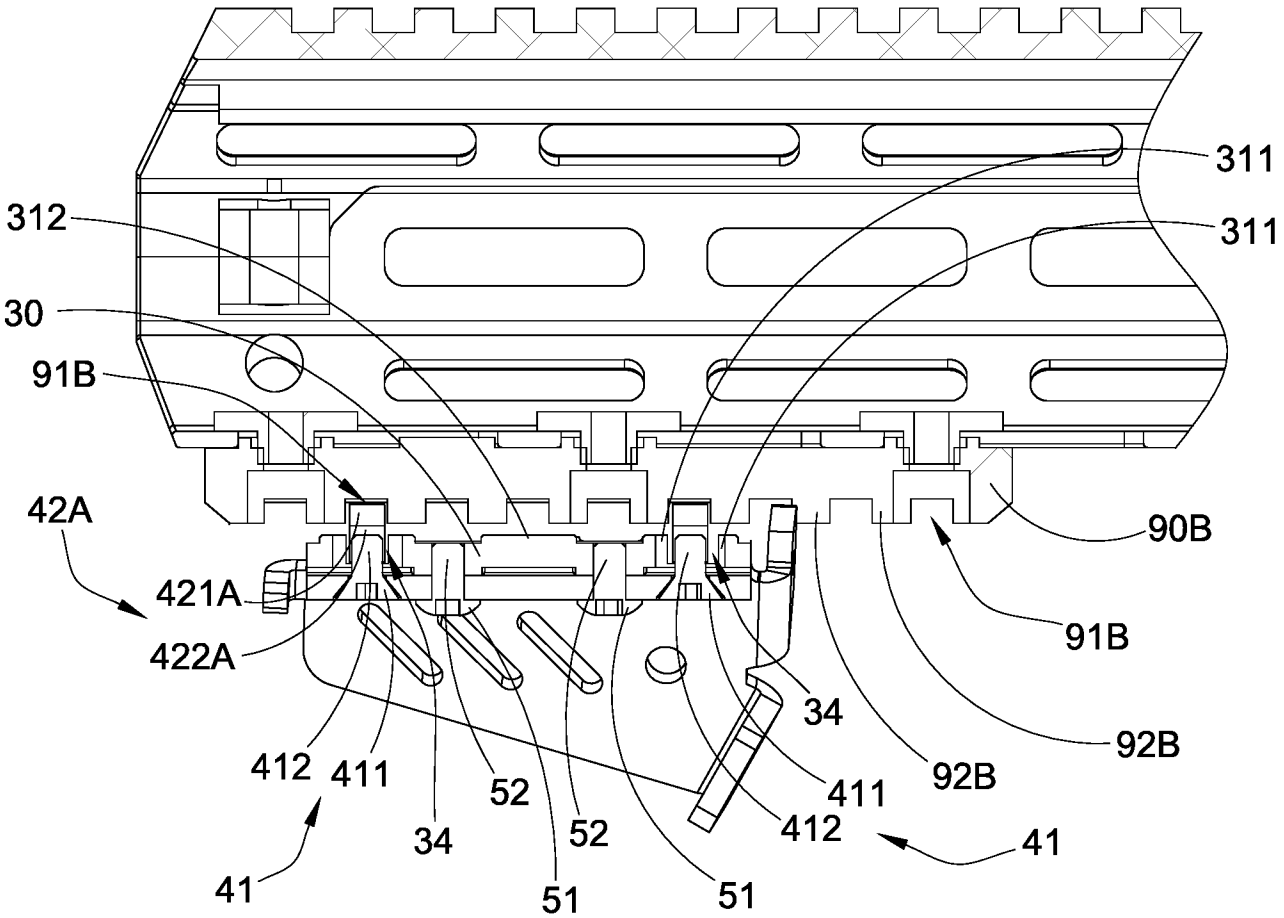
FIG. 6 is a sectional view of a 3-in-1 adapter engaged with a Picatinny rail engagement interface according to the above mentioned preferred embodiment of the present invention
Figure 7:
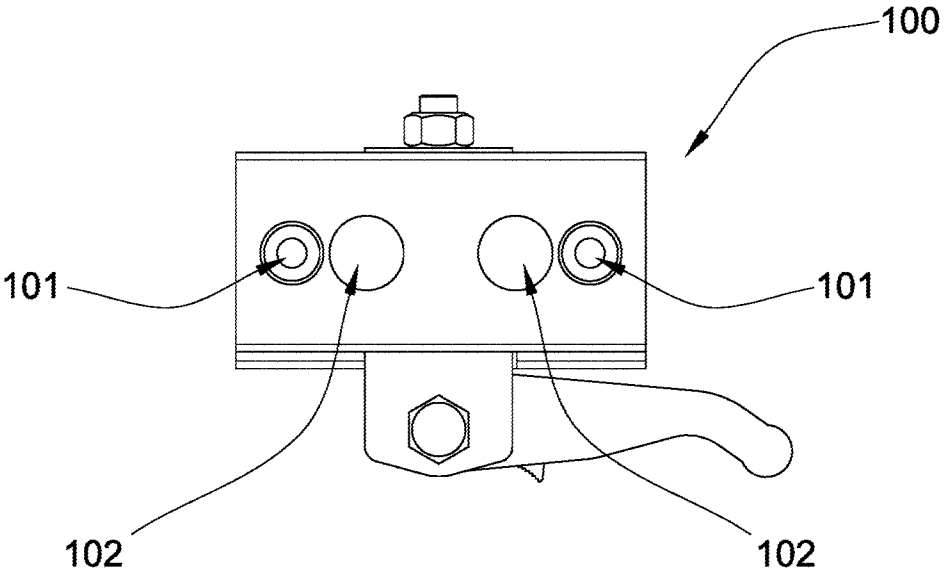
FIG. 7 is a bottom view of a quick releasing mount according to the above preferred embodiment of the present invention.
Figure 8:
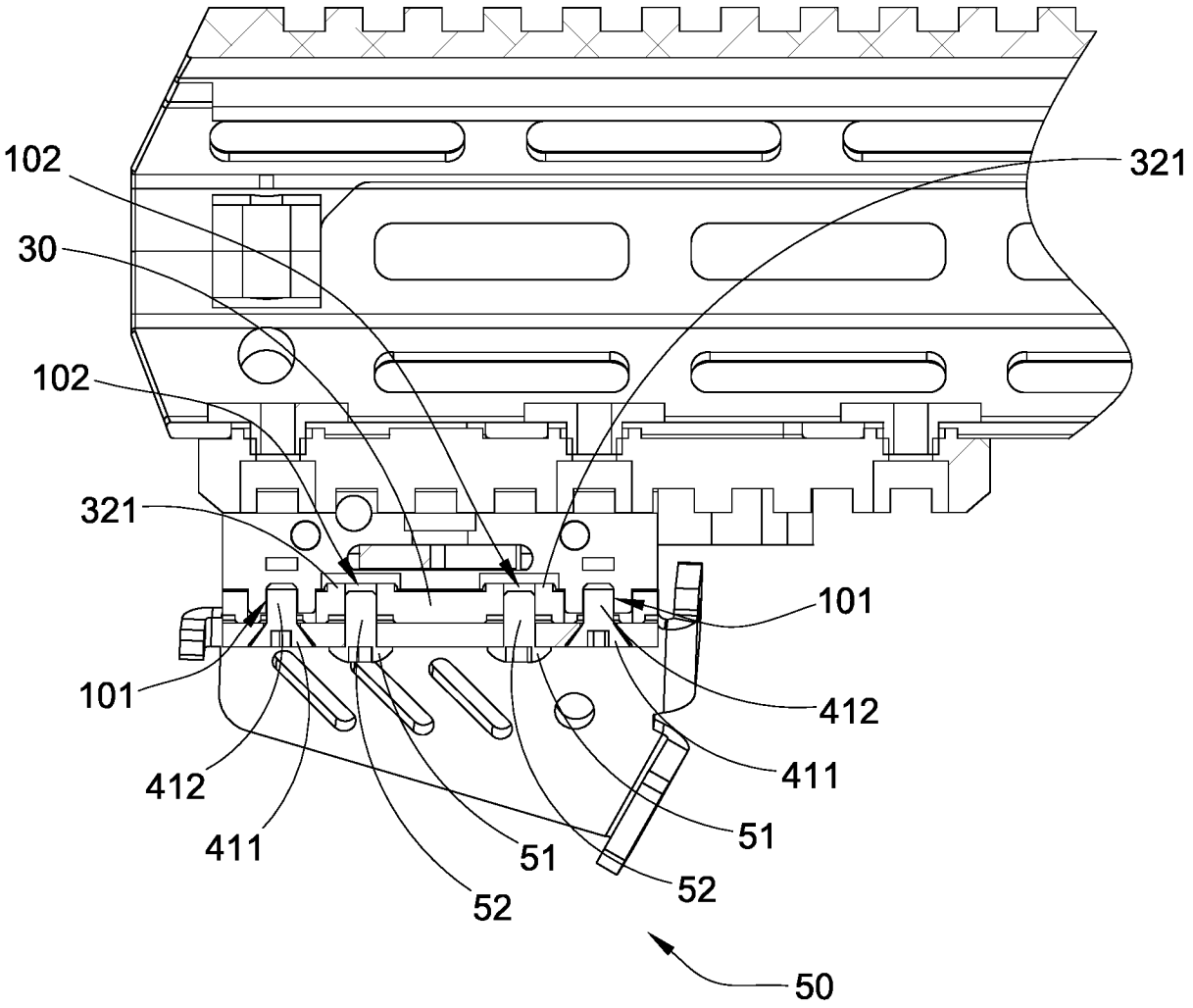
FIG. 8 is a sectional view of a 3-in-1 adapter engaged with a quick releasing mount according to the above preferred embodiment of the present invention.

Referring to FIG. 6 of the drawings, the engagement interface 90B is defined as a "Picatinny" rail engagement interface 90B, wherein the Picatinny rail engagement interface 90B comprises a plurality of transverse ridges 92B and a plurality of Picatinny openings 91B are defined between two ridges 92B. And, the elongated nut 42A is adapted to apply to the "Picatinny" rail engagement interface 90B.

In order to affix the 3-in-1 mount adapter on the engagement interface 90B, the bottom side 32 of the mounting plate 30 is abutted with the concave wall 114 of the attachment base 10, and the top side 31 is maintained in generally abutting cooperation with the engagement interface 90B of the firearm, wherein the engagement interface 90B of the firearm is sandwiched between the mounting plate 30 and the two ears 421A of the elongated nut 42A. The screw tail 412 of the screw 41 is passed through the affixing hole 111 of the concave wall 114 and the screw hole 33 on the mounting plate 30 respectively, and at the same time the screw heads 411 of the screws 41 are blocked on the concave wall 114 of the attachment base 10 to affix the mounting plate 30 on the concave wall 114 of the attachment base 10. Each of the threaded portions 412 of the bolts 41 is passed through the mounting hole 112 of the concave wall 114 and engaged with the threaded recess of the first ridge 422A while the first ridge 422A is received into the ridge receiving through hole 34, and at the same time, the two ears 421A of the elongated nut 42A head are arranged along a vertical direction with respect to the mounting plate 30. In order to mount the attachment base 10 on the engagement interface 90A, the two ears 421A of the elongated nut 42A are adapted to be slid into the Picatinny openings 91A.

Alternatively, the present invention can be incorporated with a well-known Picatinny-type mount 100 to affix the 3-in-1 mount adapter on the firearm, wherein the well-known Picatinny-type mount 100 is a quick-releasing mount comprising two spacedly arranged bolt holes 101 located on a bottom surface of the mount 100. The threaded portion 412 of the bolt 41 is screwed at and passed through the affixing hole 111 and the ridge receiving through hole 34 respectively to screw into the bolt holes 101 on the mount 100 for affixing the 3-in-1 mount adapter on the mount 100. In other words, the bottom side 32 of the mounting plate 30 is abutted to the bottom surface of the Picatinny-type mount 100, and the top side 31 of the mounting pate 30 is abutted to the concave wall 114 of the attachment base 10.

It is worth mentioning that the Picatinny-type mount 100 further comprises two positioning holes 102 matched with the position of the third projection 321, so the third projection 321 can be received into the two positioning holes 102 to enhance a connection between the bottom surface of the mount 100 and the mounting plate 30. The configuration between the third projections 321 and the positioning holes 102 can reduce fluctuation forces generated between the mount 100 and the mounting plate 30, so as to reduce the fluctuation for the firearm.

The present invention further provides a method of affixing a 3-in-1 mount adapter on a firearm having an engagement interface 90 with a plurality of openings 91, 91A, 91B, wherein the method comprises the following steps:

(1) Screw at least one screw 50 in a affixing hole 111 of an attachment base 10 and in a mounting plate 30 respectively;

(2) Screw a threaded portion 52 of a bolt 50 in a mounting hole 112 of the attachment base 10, and then the threaded portion 412 of the bolt 41 is passed through a ridge receiving through hole 34 of the mounting plate 30; and (3) Screw a nut 42, 42A with the threaded portion 412 of the bolt 41 to affix the engagement interface 90 between a nut head of the nut and the mounting plate.

Accordingly, the openings 91 are designed as Keyhole configurations while the 3-in-1 adapter is applied to an engagement interface 90 having a "Key-mod" rail engagement interface 90, wherein each of the openings 91 comprises an enlarged opening portion 911 and a narrower opening portion 912. The step (3) further comprises the following steps:

(3.1a) Slide the nut head 421 from the enlarged opening portion 911 to the narrower opening portion 912 to block the nut head 421 on the engagement interface 90 of the firearm.

In the step (3.1a), the nut head 421 is a circular nut head having an area smaller than that of the enlarged opening portion 911 and larger than that of the narrower opening portion 912. It is worth mentioning that the mounting plate 30 comprises at least one third projection 321 positioned around an outer circumference of the screw hole 33, wherein the third projection 321 is shaped and positioned to cooperate with the configuration of the K-mod openings 91. Therefore, a thickness of the third projection 321 provides a clearance for a thickness of the engagement interface 90 of the firearm, so the engagement interface 90 of the firearm is sandwiched between the circular nut head 421 and the mounting plate 30.

Accordingly, the openings 91 are designed as elongated slots 91A while the 3-in-1 adapter is applied to an engagement interface 90 having a "M-lok" rail engagement interface 90A. The step (3) further comprises the following steps:

(3.1b) Slide the nut head 421 along the elongated slot 91A to block the nut head 421 on the engagement interface 90A.

In the step (3.1b), the nut head 421 are defined as two ears 421A radially extended from a first ridge 422A of the nut 42, wherein one of the two ears 421A is overlapped with the engagement interface 90A to affix the nut head 421 thereon. It is worth mentioning that the mounting plate 30 comprises at least one second projection 312 positioned around an outer circumference of the ridge receiving through hole 34, wherein the second projection 312 is shaped and positioned to cooperate with the configuration of the M-lok openings 91A. In other words, a thickness of the second projection 312 provides a thickness for a thickness of the M-lok engagement interface 91A while the engagement interface 91A is sandwiched between one of the two ears 421A and the mounting plate 30.

The present invention further provides a method of affixing a 3-in-1 adapter on a quick-releasing mount 100 comprises the following steps:

(a) affix a mounting plate 30 on an attachment plate 10 through at least one screws 50; and (b) screw a threaded portion 412 of a bolt 41 on a mounting hole 112 of the attachment base 10, and the threaded portion 412 of the bolt 41 is passed through a ridge receiving through hole 34 of the mounting plate 30, and screwed on a bolt hole 101 arranged on the quick-releasing mount 100 to affix the 3-in-1 adapter mount on the quick-releasing mount 100.

Accordingly, the well-known quick-releasing mount 100 further comprises at least one positioning hole 102. The mounting plate 30 further comprises at least one third projection 321 positioned around an outer circumference of the screw hole 33, wherein the third projection 321 is shaped and positioned to match with a positioning hole 102 formed on the quick-releasing mount 100, and engaged with the positioning hole 102 to increase friction forces for the connection between the mounting pate 30 and the quick-releasing mount 100. Therefore, the configuration between the third projection 321 and the positioning hole 102 can reduce fluctuation forces generated between the quick-releasing mount 100 and the mounting plate 30, so as to reduce the fluctuation for firearm.

Figure 9A:
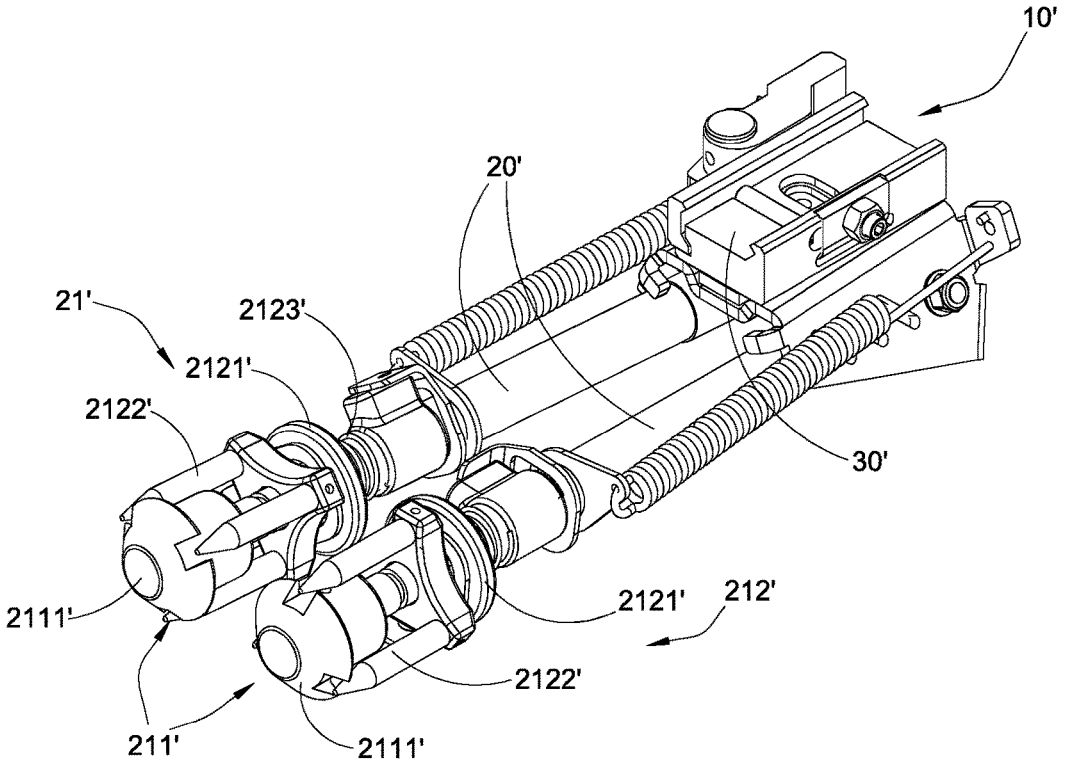
FIGS. 9A and 9B illustrate an alternative mode of a 3-in-1 adapted according to the above mentioned preferred embodiment of the present invention.
Figure 9B:
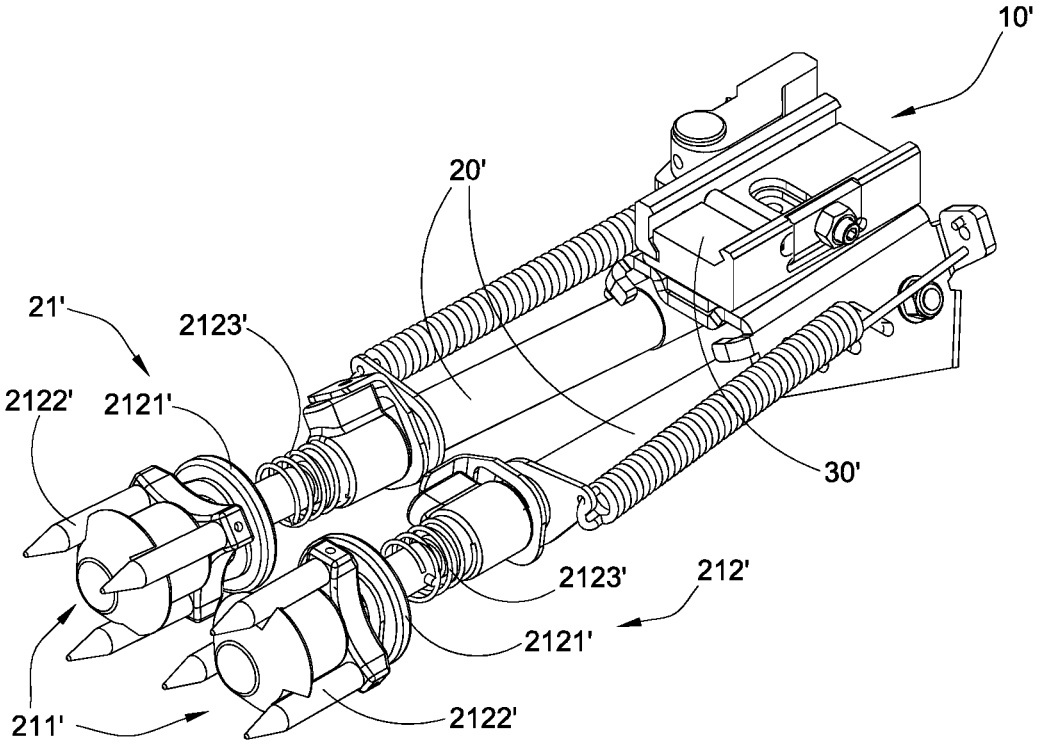

Referring to FIGS. 9A to 9B, an alternative mode of the 3-in-1 adapter according to the above preferred embodiment is illustrated, which also includes the attachment base 10', the leg frame 20' to stably hold and support the firearm in a position, a mounting plate 30' for detachably engaging with the attachment base 10' with the leg frames 20' for support the attachment base 10' being coupled with the firearm. The main difference in this alternative mode with the above preferred embodiment is the leg frame 20', each of which comprises a stand 21' at a distal end portion thereof. Each of said stands 21' comprises first standing member 211' having a base 2111' adapted for standing on solid flat surface such as ground surface and an extensible second standing member 212' which comprises a ring-shaped supporter 2121', one or more spikes 2122' extending from the supporter 2121' and a spring mechanism 2123' extended between the supporter 2121' and a stopper 22' affixed to a lower portion of the respective leg frame 20'. Each of the supporter is sleeved on the respective leg frame 20 in a movable manner that when the second standing member 211' is retracted towards the attachment base 10' as shown in FIG. 9A, the base 2111' of the first standing member 211' is positioned lower than the retracted second standing member 212' so that the leg frames 20' is adapted to stand on a ground surface, and that when the second standing member 212' is extended out to a position lower than the first standing member 211' as shown in FIG. 9B, the one or more spikes 2122' protrude out for inserting into a soft surface such as sand surface so that the leg frames 20' is adapted to stand on a soft surface.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A 3-in-1 mount adapter for a firearm having an engagement interface with a plurality of openings, comprising:

an attachment base having at least one mounting hole;

a mounting plate comprising at least one ridge receiving through hole aligned with said mounting hole; and at least one fastener assembly comprising a nut having a ridge passed through said ridge receiving through hole and said openings of said firearm, and a bolt comprising a threaded portion engaged with said nut and screwed in said mounting hole for affixing said attachment base with said mounting plate, wherein said nut comprises a nut head radially extended from said ridge and having an cross sectional area larger than an area of said mounting hole to block said nut head on said mounting plate, wherein said attachment base comprises a two top side walls and a concave wall downwardly extended from two top side walls to form a receiving cavity for receiving said mounting plate.

2. A 3-in-1 mount adapter for a firearm having an engagement interface with a plurality of openings, comprising:

an attachment base having at least one mounting hole;

a mounting plate comprising at least one ridge receiving through hole aligned with said mounting hole; and at least one fastener assembly comprising a nut having a ridge passed through said ridge receiving through hole and said openings of said firearm, and a bolt comprising a threaded portion engaged with said nut and screwed in said mounting hole for affixing said attachment base with said mounting plate, wherein said nut comprises a nut head radially extended from said ridge and having an cross sectional area larger than an area of said mounting hole to block said nut head on said mounting plate, wherein said bolt further comprises a head portion having a cross section area larger than an area of the mounting hole to block said head portion of said bolt on said attachment base, wherein said mounting plate is defined by a top side and a bottom side, wherein said bottom side comprises at least one projection positioned to cooperate with said openings.

3. The mount adapter, as recited in claim 2, wherein said openings comprises an enlarged opening portion and a narrower opening portion extended from the enlarged opening portion.

4. The mount adapter, as recited in claim 3, wherein said nut head is a circular nut head having an area smaller than that of said enlarged opening portion and larger than that of said narrower opening portion, wherein said circular nut head is slid from said enlarged opening portion to said narrower opening portion to lock on said narrower opening portion.

5. A 3-in-1 mount adapter for a firearm having an engagement interface with a plurality of openings, comprising:

an attachment base having at least one mounting hole;

a mounting plate comprising at least one ridge receiving through hole aligned with said mounting hole; and at least one fastener assembly comprising a nut having a ridge passed through said ridge receiving through hole and said openings of said firearm, and a bolt comprising a threaded portion engaged with said nut and screwed in said mounting hole for affixing said attachment base with said mounting plate, wherein said nut comprises a nut head radially extended from said ridge and having an cross sectional area larger than an area of said mounting hole to block said nut head on said mounting plate, wherein said bolt further comprises a head portion having a cross section area larger than an area of the mounting hole to block said head portion of said bolt on said attachment base, wherein said openings are elongated slots, wherein said mounting plate is defined by a top side and a bottom side, wherein said top side said comprises at least one projection positioned around an outer circumference of said ridge receiving hole to provide a thickness for said engagement interface of said firearm.

6. The mount adapter, as recited in claim 5, wherein said nut head is an elongated nut head having two tears, wherein an area of said elongated nut head is smaller that of said openings, and said elongated nut head is passed through said openings.

7. The mount adapter, as recited in claim 6, wherein said engagement interface is sandwiched between one of said two ears of said elongated nut head and said mounting plate to affix said mounting plate on said engagement interface.

8. A 3-in-1 mount adapter for a quick-releasing mount having at least one bolt holes located on a bottom surface thereof, comprising:

an attachment base having at least one mounting hole;

a mounting plate comprising at least one ridge receiving hole aligned with said mounting hole; and a bolt comprising a threaded portion screwed on said mounting hole and passed through said ridge receiving hole to screw in said bolt hole for affixing said attachment base and said mounting plate on said quick-releasing mount, wherein said bolt further comprises a head portion having an area larger than that of the mounting hole to block said head portion of said bolt on said attachment base, wherein said attachment base comprises a two top side walls and a concave wall downwardly extended from two top side walls to form a receiving cavity for receiving said mounting plate.

9. A method for affixing a 3-in-1 mount adapter on a firearm having an engagement interface with a plurality of openings comprising the steps of:

(a) screwing at least one screw in an affixing hole of an attachment base and into a screw of a mounting plate respectively;

(b) screwing a threaded portion of a bolt in a mounting hole of said attachment base, and said threaded portion of said bolt is passed through a ridge receiving through hole of said mounting plate; and (c) screwing a nut with said threaded portion of said bolt to affix said engagement interface between a nut head of said nut and said mounting plate.

10. The method, as recited in claim 9, wherein each of said openings comprises an enlarged opening portion and a narrower opening portion, wherein the step (c) further comprises a step of:

(c. 1) sliding said nut head from said enlarged opening portion to said narrower opening portion to block said nut head on said engagement interface of said firearm.

11. The method, as recited in claim 10, wherein said nut head is a circular nut head having an area smaller than that of said enlarged opening portion and larger than that of said narrower opening portion.

12. The method, as recited in claim 11, wherein said mounting plate comprises at least one second projection positioned around an outer circumference of said ridge receiving through hole to provide a thickness for said engagement interface of said firearm.

13. The method, as recited in claim 9, wherein each of said openings is an elongated slot, wherein the step (c) further comprises a step of:

(c. 1) sliding said nut head along said elongated slot to block said nut head on said engagement interface.

14. The method, as recited in claim 13, wherein said nut head are defined as two tears radially extended from a ridge of said nut, wherein one of said two ears is overlapped with said engagement interface to affix said nut head thereon.

15. The method, as recited in claim 14, wherein said mounting plate comprises at least one third projection positioned around an outer circumference of said screw hole, wherein said third projection is shaped and positioned to cooperate with the configuration of said openings.

16. A method for affixing a 3-in-1 mount adapter on a quick-releasing mount comprising the steps of:

(a) affixing a mounting plate on an attachment plate through at least one screw: and (b) screwing a threaded portion of a bolt in a mounting hole of said mounting plate, and then said threaded portion of said bolt is passed through a ridge receiving through hole of said attachment base, and is screwed in a bolt hole arranged on said quick-releasing mount to affix said 3-in-1 adapter mount with said quick-releasing mount, wherein said mounting plate comprises at least one projection positioned around an outer circumference of said screw hole, wherein said projection is positioned to match with at least one positioning hole formed on said quick-releasing mount.

* * * * *